United States Patent [19]

Nawata

[11] Patent Number: 4,951,091

[45] Date of Patent: Aug. 21, 1990

[54] IMAGE FORMING APPARATUS HAVING TONER QUANTITY DETECTION MEANS

[75] Inventor: Yoshiaki Nawata, Yokohama, Japan

[73] Assignee: Kabushiki Kaisha Toshiba, Kawasaki, Japan

[21] Appl. No.: 277,845

[22] Filed: Nov. 30, 1988

[30] Foreign Application Priority Data

Nov. 30, 1987 [JP] Japan ..... 62-302636

[51] Int. Cl.[5] ..... G03G 15/09; G03G 15/00

[52] U.S. Cl. ..... 355/206; 355/246

[58] Field of Search ..... 355/203–209, 355/245, 246, 326; 118/688–691, 694

[56] References Cited

U.S. PATENT DOCUMENTS

| | | | |
|---|---|---|---|
| 4,032,227 | 6/1977 | Hubbard et al. | 355/245 |
| 4,579,443 | 4/1986 | Abuyama et al. | 355/326 X |
| 4,619,514 | 10/1986 | Ide | 355/326 X |

FOREIGN PATENT DOCUMENTS

| | | | |
|---|---|---|---|
| 61-170764 | 8/1986 | Japan | 355/208 |
| 61-215573 | 9/1986 | Japan | 355/208 |

*Primary Examiner*—Joan H. Pendegrass

*Attorney, Agent, or Firm*—Foley & Lardner, Schwartz, Jeffery, Schwaab, Mack, Blumenthal & Evans

[57] ABSTRACT

An image forming apparatus includes a main charger and an exposure unit for forming an electrostatic latent image on a photosensitive drum, a developing unit for developing the latent image, a resupply unit for resupplying the developing unit with toner, an auto-toner sensor for detecting the concentration of the developing agent in the developing unit, a toner-empty mechanism for detecting the quantity of toner remaining in the resupply unit, and a display section for indicating the need for replenishment of the resupply unit with toner. If a shortage of toner in the resupply unit is detected by toner-empty mechanism, the display section displays a mark indicating the need to replenish the resupply unit, but does not interrupt a copying operation in progress, while if the auto-toner sensor detects that the concentration of the developing agent in the developing unit is below a predetermined value, the display section displays a message to the effect that the resupply unit should be replenished with toner, and stops the copying operation in progress.

5 Claims, 6 Drawing Sheets

IMAGE FORMING APPARATUS HAVING TONER QUANTITY DETECTION MEANS

BACKGROUND OF THE INVENTION

1. Field of the Invention

The present invention relates to an image forming apparatus, such as an electronic copying machine.

2. Description of the Related Art

Conventional electronic copying machines comprise a developing unit for developing an electrostatic latent image formed on a photosensitive drum, a toner resupply unit for resupplying the developing unit with toner, and a control panel for operating the copying machine.

The toner resupply unit includes a toner hopper for storing toner, a toner resupply roller for resupplying with toner in the hopper, as required, i.e. according to the copying frequency, and a suppliable-toner detection switch for detecting the quantity of toner remaining in the toner hopper. The control panel includes, among other things, a display section which indicates a shortage in the amount of toner remaining, in accordance with the detection of such by the suppliable-toner detection switch.

In the case of the above conventional copying machines, the supply of toner to the developing unit ceases once a shortage of toner in the hopper is indicated on the display section. Therefore, if copying continues beyond this point, the copy images obtained will not be of a satisfactory density and contrast.

SUMMARY OF THE INVENTION

The object of the present invention is to provide an image forming apparatus which can indicate a shortage of toner in two stages, in order to prevent the production of low-density images.

According to an aspect of the present invention, there is provided an image forming apparatus comprising latent image forming means for forming a latent image on an image carrier, developing means, containing a developing agent, for developing the latent image with the developing agent, resupply means for resupplying the developing means with a developing agent, first detection means, for detecting a shortage of developing agent in the developing means, second detection means, for detecting a shortage of developing agent in the resupply means, display means for indicating the need for replenishment of the developing agent, and control means for controlling the display means such that the display means indicates the need for developing agent replenishment in accordance with the detection of such by at least one of the first and second detecting means.

DETAILED DESCRIPTION OF THE PREFERRED EMBODIMENT

An embodiment of the present invention will now be described in detail, with reference to the accompanying drawings.

Figure 1:
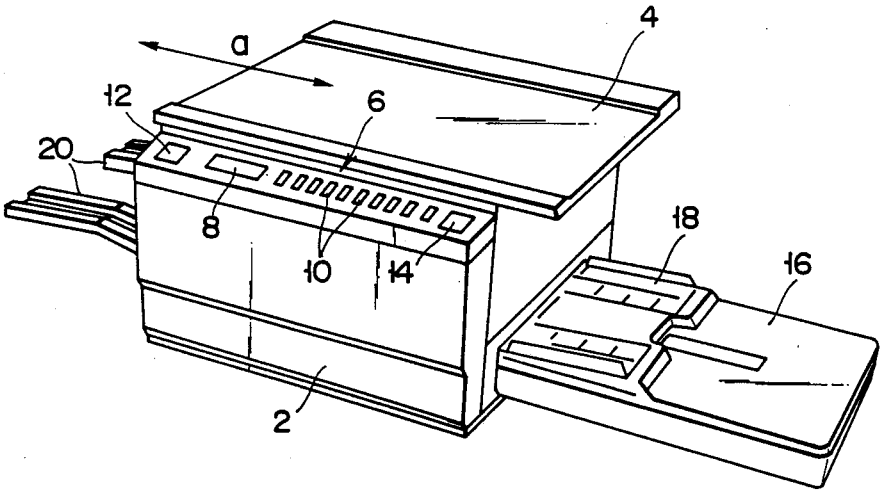
FIG. 1 is a perspective view showing an electronic copying machine as an image forming apparatus according to an embodiment of the present invention.

Referring to FIG. 1, numeral 2 denotes a housing of an electronic copying machine. Original table 4 for supporting an original is mounted on the top face of housing 2, and in the course of a copying operation, is reciprocated in the direction indicated by double-ended arrow a. Control panel 6 is located on the front side of the top face of housing 2, and is provided with a display section 8 for indicating various operating conditions of the copying machine, ten keys 10 for inputting the number of copies to be made and the like, density setting key 12 for setting the image density, and print key 14 for starting the copying operation. Sheet cassette 16 for automatic feeding of paper sheets P is attached to one side portion of housing 2, and sheet-bypass guide 18 for manual feeding of sheets P is formed on the upper surface of cassette 16. Receiving tray 20 for receiving discharged copy sheets P is attached to the other side portion of housing 2.

Figure 2:
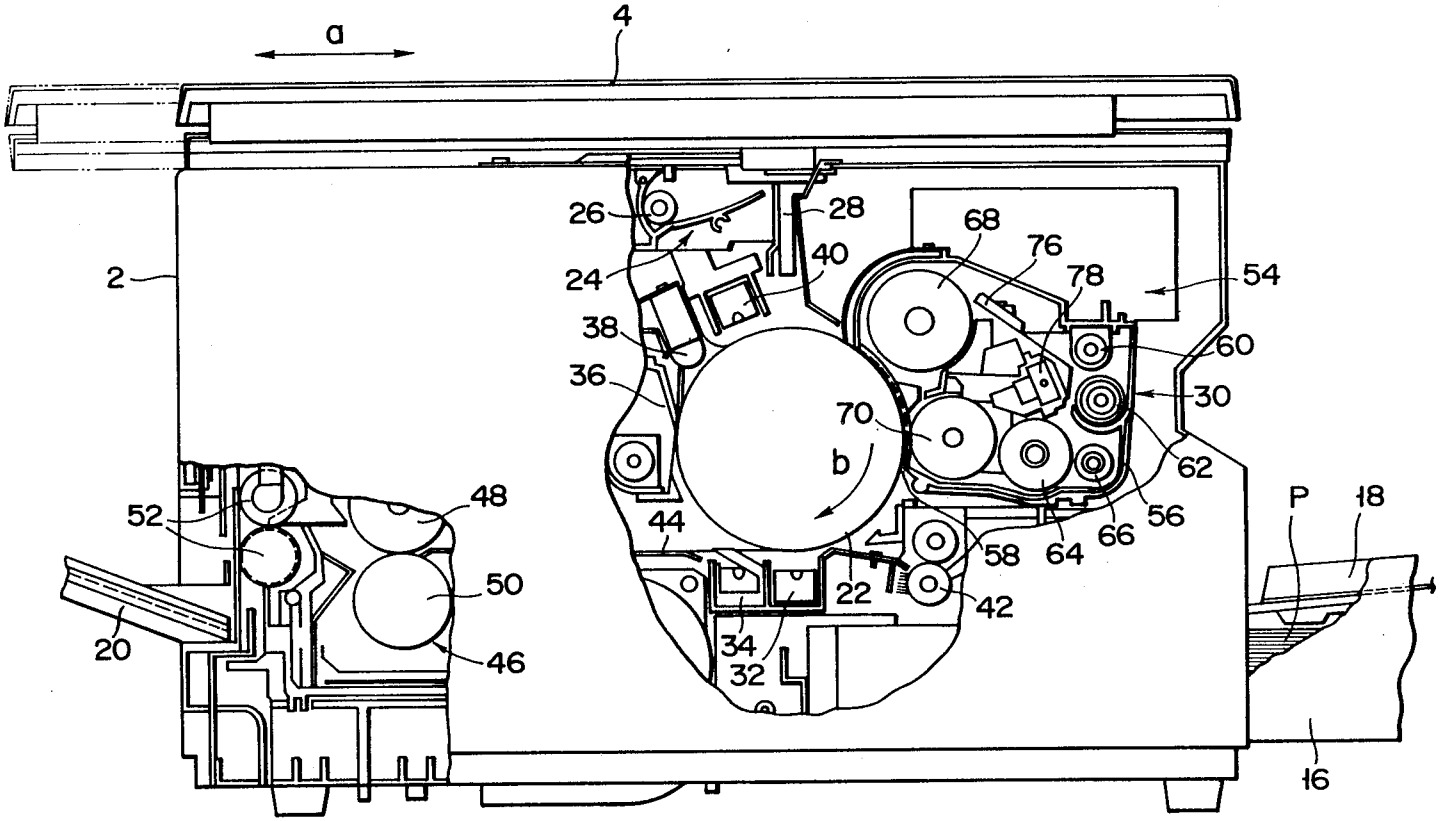
FIG. 2 is a sectional view showing the internal construction of the copying machine of FIG. 1.

As is shown in FIG. 2, photosensitive drum 22 is positioned substantially in the center of housing 2, and rotates in the direction indicated by arrow b, in synchronism with the reciprocation of original table 4. Exposure unit 24 is situated between drum 22 and table 4, and includes lamp 26 for illuminating an original placed on table 4 and convergent light transmitter (trademark: Selfoc Lens Array) 28 for guiding light reflected from the original onto drum 22, so as to form an image thereon.

Developing unit 30, transfer charger 32, separation charger 34, cleaner 36, discharge lamp 38, and main charger 40 are arranged successively along the rotating direction of photosensitive drum 22, starting at the position of image formation as performed by convergent light transmitter 28. Main charger 40 is used to charge the surface of drum 22 uniformly, and exposure unit 24 guides an optical image, which carries the image information formed on the original, to the charged surface of drum 22, thereby to form an electrostatic latent image on the drum surface. Developing unit 30 develops the latent image, using toner T, thereby forming a toner image which is transferred by transfer charger 32 onto the surface of a paper sheet P. Separation charger 34 then causes the sheet P to separate from drum 22, cleaner 36 removes any toner T remaining on the drum, and discharge lamp 38 is used to erase a residual image thereon, in so doing, lowering the potential on the drum to a predetermined level or below. The machine is then ready for the next copying operation.

Disposed between transfer charger 32 and sheet cassette 16 are sheet supply rollers (not shown) which feed paper sheets P from sheet cassette 16 or from sheet-bypass guide 18 toward transfer charger 32. A pair of aligning rollers 42 are arranged between the sheet supply rollers and charger 32, whereby a sheet P delivered through the supply rollers is aligned.

Arranged between separation charger 34 and receiving tray 20 are a conveyor belt (not shown) and a guide 44. The conveyor belt is used to transport a paper sheet P separated from drum 22 by means of charger 34, while guide 44 guides the sheet being transported by the belt. Fixing unit 46 is situated between the conveyor belt and receiving tray 20, and includes heat roller 48 and press roller 50 for fixing the toner image on sheet P. Located between fixing unit 46 and tray 20 are a pair of exit rollers 52 between which sheet P, with the toner image thereon, is discharged onto tray 20.

Figure 3:
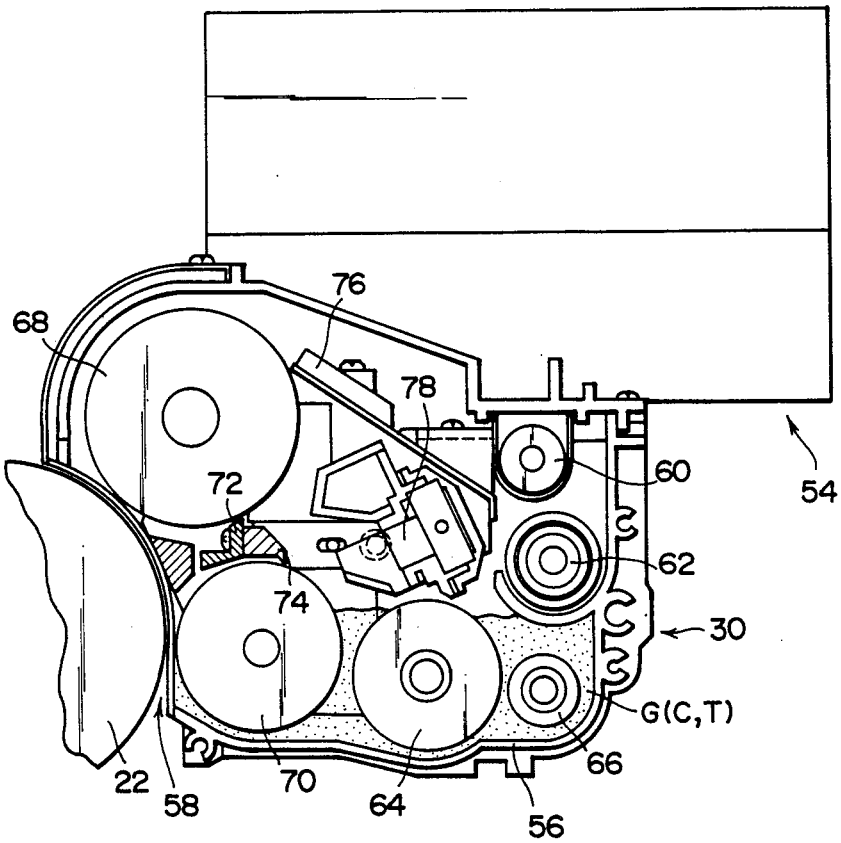
FIG. 3 shows a developing unit and a toner resupply unit used in the copying machine of FIG. 1.

As is shown in FIGS. 2 and 3, toner resupply unit 54 for resupplying developing unit 30 with toner T, is mounted on the top portion of unit 30.

Developing unit 30 includes casing 56, which has opening 58 facing photosensitive drum 22. Casing 56 contains developer G, transportation auger 60, mixing auger 62, large- and small-diameter paddles 64 and 66, and upper and lower magnet rollers 68 and 70. The casing also houses upper and lower regulating members 72 and 74, scraper 76, and auto-toner sensor 78. Developer G is a two-component one, consisting of toner T and carrier C. Toner T is non-magnetic, and carrier C is magnetic. Toner T is supplied from toner resupply unit 54, and is transported by means of anger 60 in a direction parallel to the axis of drum 22. Toner T is mixed with carrier C by means of mixing auger 62, thereby forming developer G. Paddles 64 and 66 stir developer G thus formed. Developer G is applied from rollers 68 and 70 onto the electrostatic latent image formed on drum 22. Regulating members 72 and 74 are so arranged that they form gaps between themselves and the rollers 68 and 70. They are moved, thus adjusting the gaps such that developer applied from either roller forms a layer having a desired thickness, on the surface of drum 22. Scraper 76 removes the excessive portion of developer G from roller 68. Sensor 78 detects the concentration of toner T in that portion of developer G which has been scraped from roller 68.

The magnetic resistance -and thus the toner concentration- of developer G varies according to the mixture ratio of magnetic carrier C to nonmagnetic toner T. Auto-toner sensor 78 detects the magnetic resistance of the developer, thereby detecting the toner concentration.

Figure 4:
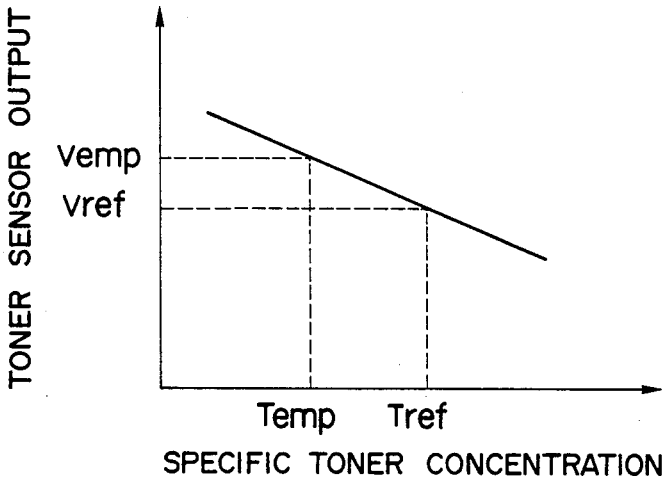
FIG. 4 is a diagram illustrating the output characteristic of an auto-toner sensor used in the developing unit shown in FIG. 3.

The output characteristic of auto-toner sensor 78, as shown in FIG. 4, is set so that the higher the toner concentration, the proportionately lower is the output voltage. More specifically, if the toner concentration is at proper value Tref, sensor 78 delivers output voltage Vref. If the toner concentration decreases from Tref to Temp, sensor 78 detects this decrease and outputs voltage Vemp higher than Vref.

Figure 5:
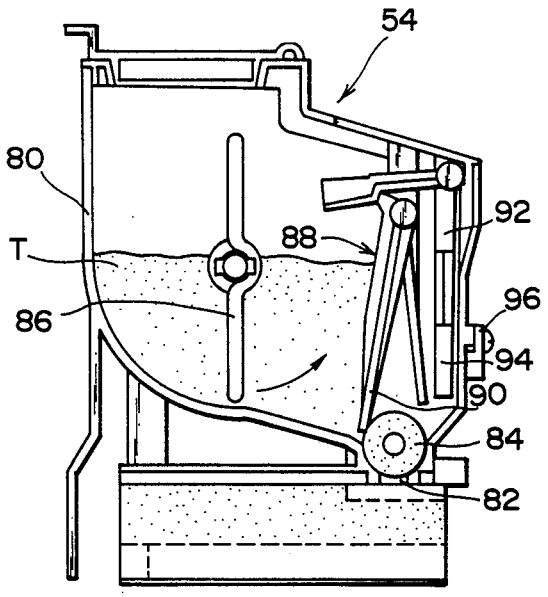
FIG. 5 is a sectional view of the toner resupply unit shown in FIG. 3.

As is shown in FIG. 5, toner resupply unit 54 includes toner hopper 80 which stores toner T. Resupply port 82 for supplying toner T is formed at the bottom of hopper 80. Resupply roller 84 is located to supply toner T from port 82 to developing unit 30 at a predetermined rate. Located within hopper 80 is toner mixer 86 which stirs and feeds toner T to roller 84. The toner hopper is also provided with a toner-empty detection mechanism 88 for detecting when there is an acute shortage of suppliable toner T within the hopper. Mechanism 88 includes lever 90, actuator 92, permanent magnet 94, and reed switch 96. Lever 90 rotates through an angle proportional to the quantity of residual toner T, and drives actuator 92. Magnet 94 is attached to the distal end portion of actuator 92, while switch 96 is located outside hopper 80, at the same level as magnet 94. When hopper 80 contains sufficient toner T, some of the toner will be present between switch 96 and magnet 94 at the distal end of actuator 92, resulting in switch 96 being off. When, on the other hand, the supply toner T in hopper 80 becomes depleted, toner ceases to be present between magnet 94 and switch 96, causing these two members to come into intimate contact with each other, thereby turning switch 96 on.

Figure 6:
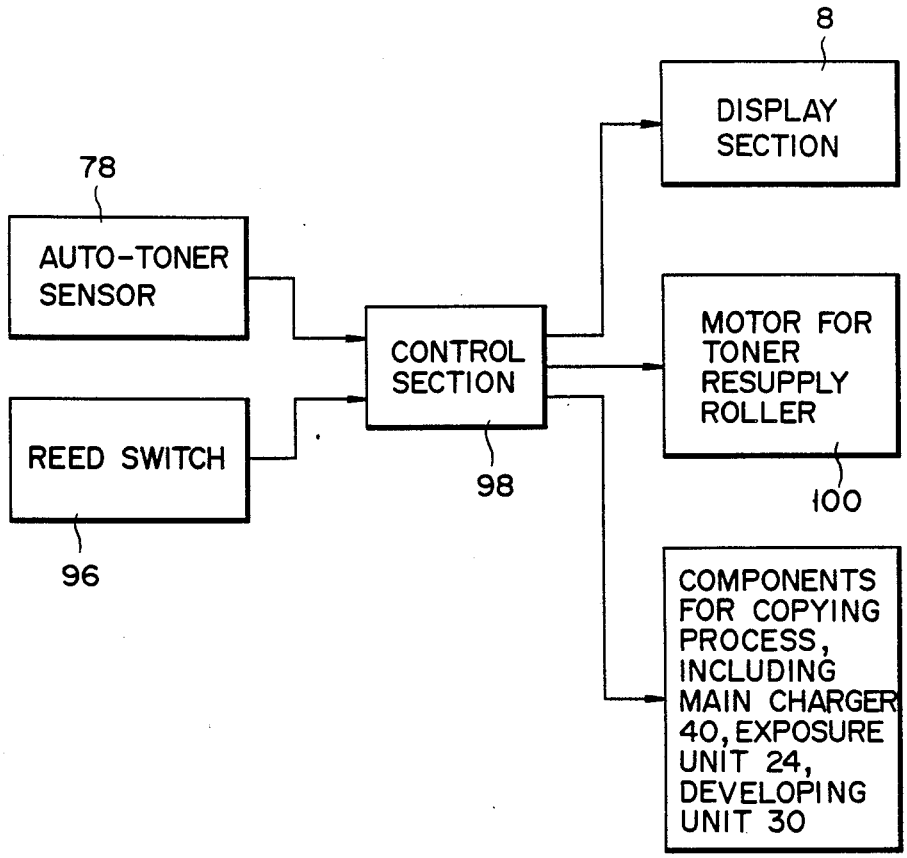
FIG. 6 is a block diagram of a control circuit for controlling the developing unit and the resupply unit shown in FIG. 3.

FIG. 6 shows a control circuit for controlling the operations of developing unit 30 and resupply unit 54. Numeral 98 designates a control section which is supplied with output signals from auto-toner sensor 78 and read switch 96. In response to these signals, control section 98 supplies control signals to display section 8 and motor 100. Control section 98 also supplies control signals to main charger 40, exposure unit 24, and developing unit 30, which cooperate to copy data. When the output voltage of sensor 78 rises above Vref, motor 100 is turned on, whereby developing unit 30 is resupplied with toner T from toner hopper 80. When toner-empty mechanism 88 detects that hopper 80 contains no toner T, display section 8 displays the message "REPLENISH TONER", and charger 40, exposure unit 24, and developing unit 30 continue to operate. When the output voltage of auto-toner sensor 78 rises above Vemp, display section 8 displays the message "SUPPLY TONER," and charger 40, exposure unit 24, and developing unit 30 cease to operate. In this case, the copying operation in progress is stopped.

Figure 7:
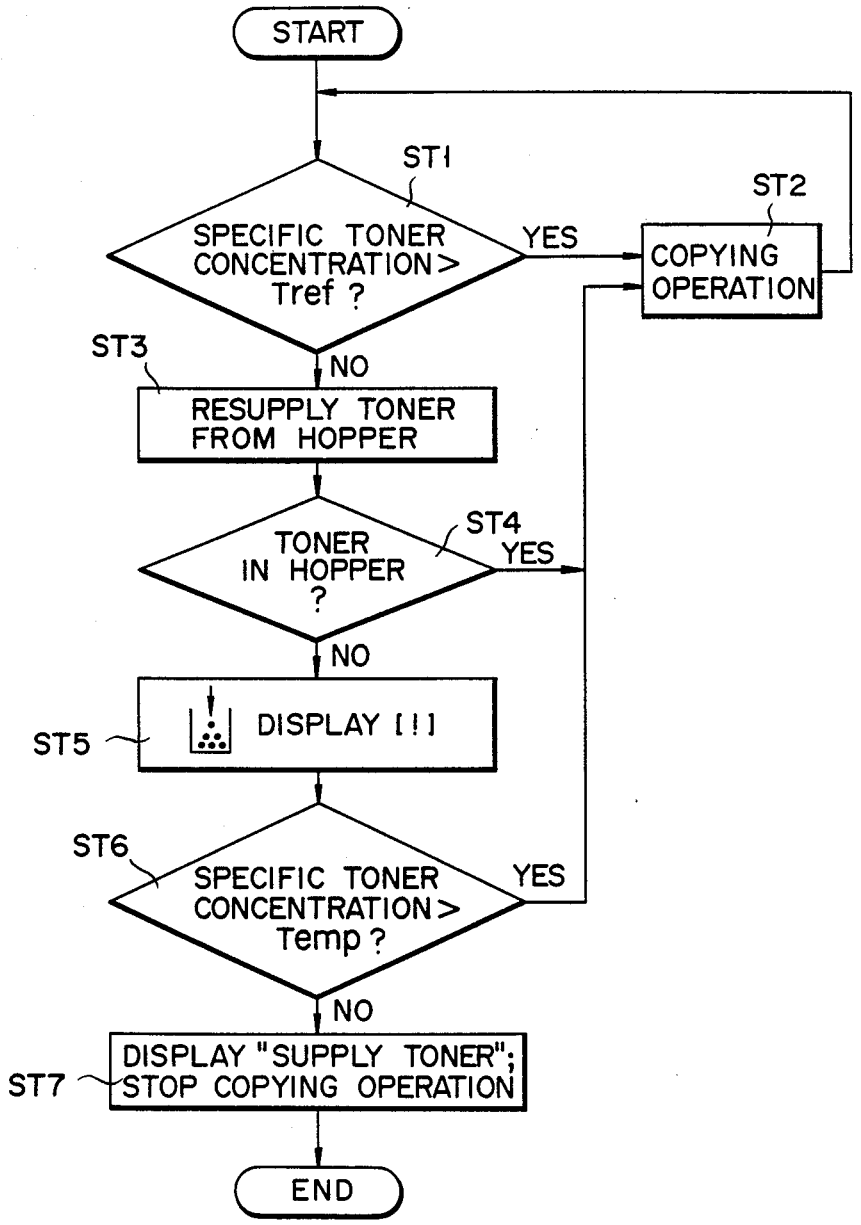
FIG. 7 is a flow chart illustrating the copying operation performed by the copying machine of FIG. 1.

Referring now to FIG. 7, control operation by control section 98 will be described.

First, in step ST1, auto-toner sensor 78 determines whether the specific toner concentration is higher than Tref. If higher than Tref, the program proceeds to step ST2; if not, it proceeds to step ST3.

In step ST2, a copying operation is performed, whereupon the program returns to step ST1. In this manner, the toner concentration is monitored continually from one copying operation to the next.

In step ST3, developing unit 30 is resupplied with toner T from toner hopper 80, whereupon the program proceeds to step ST4.

In step ST4, toner-empty mechanism 88 determines whether toner hopper 80 contains toner T. If hopper 80 is found to contain toner T, the program returns to step ST2; if not, it proceeds to step ST5.

In step ST5, display section 8 displays the predetermined mark (shown in FIG. 7) indicative of the need to replenish toner hopper 80. Then, the operation proceeds to step ST6.

In step ST6, auto-toner means 78 determines whether or not the concentration of toner T is higher than Temp. If YES, the operation return to step ST2; if NOT, it goes to step ST7, in which display section 8 displays the message "SUPPLY TONER", and the copying operation in progress is stopped.

Both a shortage of toner in hopper 80 and a shortage of toner in developing unit 30 are detected and displayed. In case such a shortage of toner is displayed, the operator can forthwith take measures necessary to supply a sufficient amount of toner to hopper 80 and developing unit 30.

If auto-toner sensor 78 detects that the concentration of toner T in developing unit 30 is too low, showing a shortage of toner T in unit 30, the copying operation in progress is stopped, whereby there is no possibility of copying an original image in too low a density. Even if toner-empty mechanism 88 detects a shortage of toner T in hopper 80, the copying operation is allowed to continue. Hence, it suffices to replenish hopper 80 with toner T before auto-toner sensor 78 detects a shortage of toner T in unit 30, in order to continue the copying operation.

What is claimed is:

1. A image forming apparatus comprising:

means for forming a latent image on an image carrier;

means for developing the latent image with a developing agent;

means for supplying the developing means with a developing agent;

first detection means for detecting a quantity of developing agent in the developing means;

second detection means for detecting a quantity of developing agent in the supply means;

means for displaying a first message indicating the need for replenishment of developing agent in the supply means and a second message indicating the need for replenishment of a developing agent in the developing means; and means for controlling the display means and the developing means such that when the display means indicates the first message the developing means allows the image forming operation in progress to continue, and for controlling the display means and the developing means such that the display means indicates the second message, the developing means stops the image forming operation when the first detection means detects the shortage of the developing agent after the second detection means detects the shortage of the developing agent in the supply means.

2. The image forming apparatus according to claim 1, wherein said control means includes means for controlling the supply means such that the supply means supplies the developing means with developing agent when the first detection means detects that the quantity of developing agent in the developing means is below a first reference quantity, and controlling the display means such that the display means displays the first message to the effect that the supply means should be replenished with developing agent when the first detection means detects that the quantity of developing agent in the developing means is below a second reference quantity, which quantity is smaller than the first reference quantity.

3. The image forming apparatus according to claim 1, wherein said first detection means has means for detecting the concentration of the developing agent in the developing means, and said control means includes means for controlling the supply means such that the supply means supplies the developing means with developing agent when the first detection means detects that the content of developing agent in the developing means is below a first reference value, and controlling the display means such that the display means displays the first message to the effect that the supply means should be replenished with developing agent when the first detection means detects that the content of developing agent in the developing means is below a second reference value, which value is smaller than the first reference value.

4. The image forming apparatus according to claim 1, wherein said first detection means includes concentration detecting means for detecting the concentration of the developing agent in the developing means.

5. The image forming apparatus according to claim 1, wherein said second detection means includes remainder-detecting means for detecting the quantity of developing agent remaining in the resupply means.

* * * * *